US005653530A

United States Patent [19]

Pittman

[11] Patent Number: 5,653,530

[45] Date of Patent: Aug. 5, 1997

[54] ORNAMENTAL LIGHTING DEVICE

[76] Inventor: Rusty M. Pittman, 555 W. Maison St., Unit 2905 Tower 1, Chicago, Ill. 60661

[21] Appl. No.: 555,271

[22] Filed: Nov. 8, 1995

[51] Int. Cl.[6] ..... F21S 1/04

[52] U.S. Cl. ..... 362/307; 362/104; 362/806; 362/405; 362/361

[58] Field of Search ..... 362/328, 329, 362/405, 186, 123, 104, 339, 327, 307, 308, 806, 355, 358, 361; 63/12

[56] References Cited

U.S. PATENT DOCUMENTS

| | | | |
|---|---|---|---|
| 3,383,675 | 5/1968 | Allardice et al. | 362/186 |
| 4,262,324 | 4/1981 | Murphy | 362/104 |
| 4,782,433 | 11/1988 | Rombough | 362/186 |
| 5,018,053 | 5/1991 | Belknap et al. | 63/12 |
| 5,323,300 | 6/1994 | McCrary | 362/104 |
| 5,383,103 | 1/1995 | Pasch et al. | 362/186 |
| 5,477,433 | 12/1995 | Ohlund | 362/104 |
| 5,497,307 | 3/1996 | Bae et al. | 362/806 |

FOREIGN PATENT DOCUMENTS

| | | | |
|---|---|---|---|
| 19968 | 11/1904 | United Kingdom | 362/104 |

*Primary Examiner*—Ira S. Lazarus
*Assistant Examiner*—Thomas M. Sember
*Attorney, Agent, or Firm*—Robert M. Sperry

[57] ABSTRACT

An improved ornamental lighting device comprising a base having an open end and a cavity communicating with said open end, a socket for receiving an electric bulb, and a wire for securing a pendant prism to said base at said open end.

15 Claims, 2 Drawing Sheets

ORNAMENTAL LIGHTING DEVICE

FIELD OF INVENTION

This invention relates to ornamental lighting and is particularly directed to ornamental lighting for chandeliers, candelabra, decorative lamps or Christmas tree lights and the like.

PRIOR ART

Pendant prisms have been used for hundreds of years in ornamental lighting to enhance the light from lamps, chandeliers, candelabra, and the like by reflecting and refracting the light from a light source, such as a candle, gas flame or light bulb. These pendant prisms are usually suspended adjacent the light source so that light from the light source will be incident on the prism surfaces externally for reflection and refraction. Although these external light sources in prior art are necessary to illuminate the pendant prisms as well as provide lighting to the room they are often distracting and reduce the decorative appearance of chandeliers and candelabra. It has also been possible to hang pendant prisms on Christmas trees and the like in order to decorate the branches. The translucent pendant prisms, however, become poorly visible at night unless an external light source is available such as an adjacent Christmas tree light bulb. Unfortunately, no means has been suggested heretofore for combining pendant prisms and the light source into a single unit in the prior art of ornamental lighting for chandeliers, candelabra, decorative lamps or Christmas tree lights. Combining the light source and prism into a single unit would not only allow for the reduction or complete elimination of external light sources in chandeliers, candelabra, and other ornamental lights such as Christmas tree lights but internally illuminating the pendant prism would provide a new visual effect. Thus, none of the prior art of ornamental lighting systems has been entirely satisfactory.

BRIEF SUMMARY AND OBJECTS OF INVENTION

These disadvantages of the prior art are overcome with the present invention and improved ornamental lighting devices are provided which enable pendant prisms to be releasably combined with a miniature light source into a single unit to be employed in ornamental lighting systems such as chandeliers, candelabra, decorative lamps Christmas tree lights and the like. In this improved ornamental lighting device internal lighting is used to illuminate the pendant prisms. Internally lighting the pendant prisms will allow for the reduction or complete elimination of separate, external light sources previously needed to illuminate the pendant prisms and/or provide lighting to a room. Reducing or completely eliminating the use of external lighting in ornamental lighting systems such as chandeliers, candelabra and decorative lamps can greatly enhance their decorative appearance. A pendant prism with internal lighting also provides a unique Christmas tree ornament which will be easily visible at night even without an external light source. In addition, internally lighting a pendant prism provides a unique and alternative appearance than that observed with external lighting since the resulting pattern of reflected and refracted light produced from an internal light source is significantly different than that produced from an external light source The present invention is attained through the recent development of miniature light sources and miniature sockets. Earlier light sources were considerably larger and could not easily be combined with the pendant prisms into a single unit. Since most pendant prisms are relatively small in size the light sources in prior art were placed adjacent to the pendant prisms for refraction and reflection.

The present invention is comprised of a base having an open end, a cavity communicating with said open end, a socket for receiving an electric bulb, a reflector at said open end, and means for releasably securing a portion of a pendant prism to said base at said open end.

Accordingly, it is an object of the present invention to provide an improved ornamental lighting device.

An additional object is to provide an improved ornamental lighting device incorporating a pendant prism.

Another object of the present invention is to provide an improved ornamental lighting device which enables a pendant prism to be combined with a light source into a single unit.

A further object of the present invention is to provide an improved ornamental lighting device which enables a pendant prism to be internally lighted for alternate and unique reflection and refraction.

Another object of the present invention is to provide an improved ornamental lighting device to be employed either individually or incorporated into an ornamental light system such as a chandelier, candelabra, decorative lamps or Christmas tree light set and the like.

An additional object is to provide an improved ornamental lighting device, an internally lighted pendant prism, which can be used as the sole light source of an ornamental system or as a secondary light source in combination with other primary light sources which are external to the pendant prism.

A specific object of the present invention is to provide an improved ornamental lighting device comprising a base having an open end and a cavity communicating with said open end, a socket for receiving an electric bulb, a reflector to reflect light from said bulb toward said open end, and a means for securing a pendant prism to said base at said open end.

These and other objects and features of the present invention will be apparent from the following detailed description, taken with reference to the figures of the accompanying drawing.

DETAILED DESCRIPTION OF THE INVENTION

Figure 1:
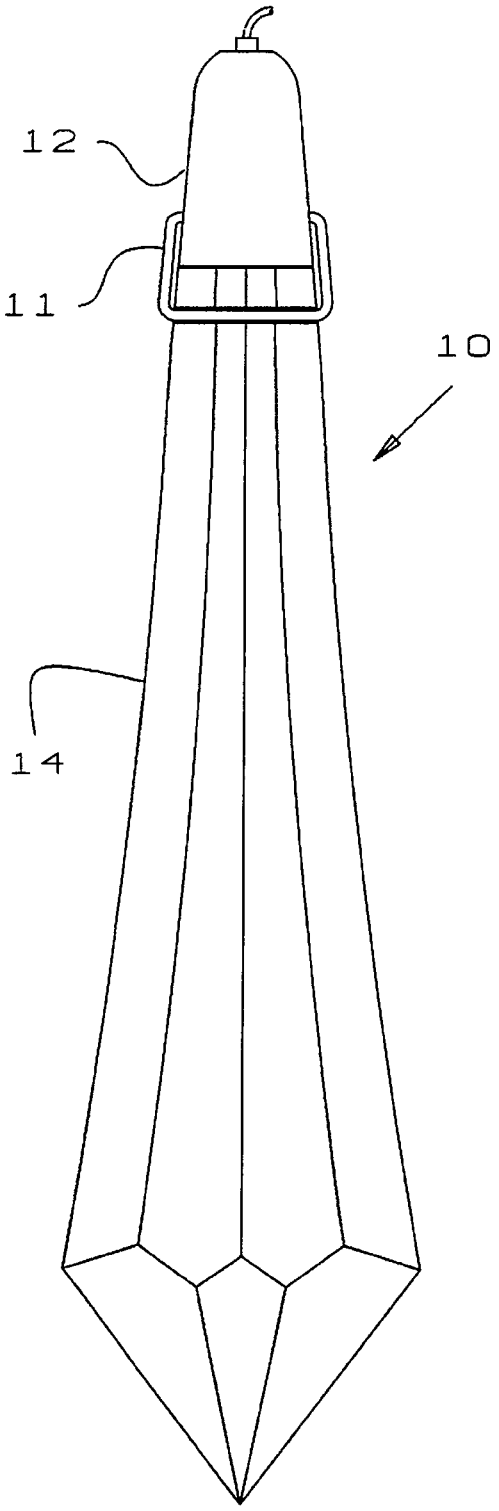
FIG. 1 is an ornamental lighting device embodying the present invention to be used in an ornamental lighting system such as a chandelier, candelabra, decorative lamp or other ornamental lighting such as Christmas tree lights.
Figure 2:
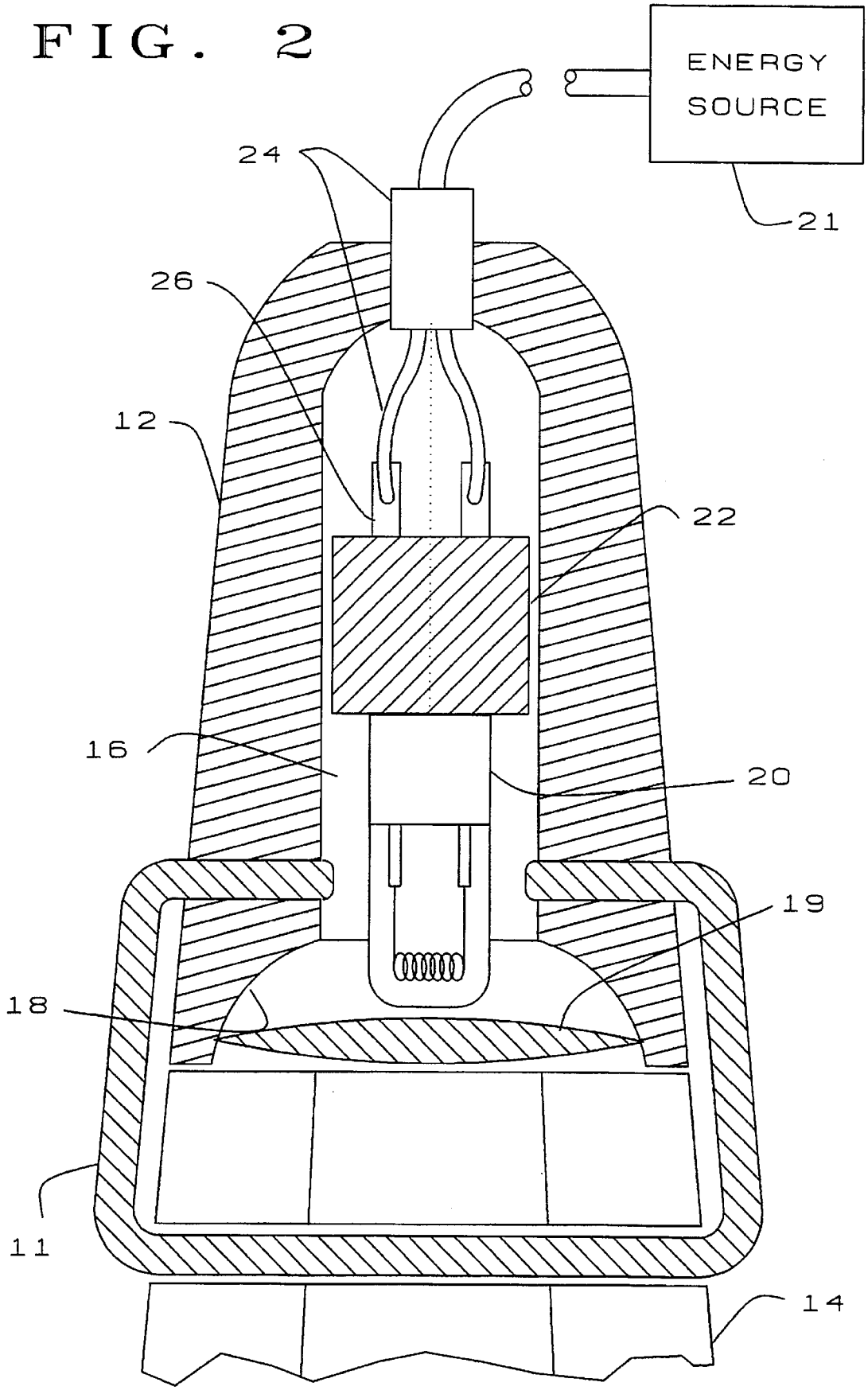
FIG. 2 is a cross section through the base of the ornamental lighting device of FIG. 1.

The present invention is illustrated in the drawing, FIG. 1. FIG. 1 shows an ornamental lighting device, indicated generally at 10, comprising a "bullet" shaped base 12 with a pendant prism 14 attached to the base 12 by means of an attachment wire 11. The pendant prism is typically comprised of translucent, cut or molded glass or crystal (leaded glass). As best seen in FIG. 2, the base 12 has a central cavity 16 which communicates with the pendant prism 14. The light source, in this case a miniature incandescent bulb 20, is releaseably mounted within the cavity 16 of the base 12, by a suitable means, such as a miniature socket 22. The socket 22 is the means for supplying energy to the bulb 20 and releaseably holds the bulb 20 in position. The end of the cavity 16 communicating with the pendant prism 14 has a reflective surface 18 which in this case is parabolically shaped to increase the amount of light directed into the pendant prism by reflecting light from the bulb 20. Also, if desired, a lens 19 may be mounted in the cavity 16 between the bulb 20 and the prism 14 to focus the light from the bulb 20. The incandescent bulb 20 is energized through electrical wires 24, which may be connected to a power supply suitable source of electrical energy, indicated generally at 21, such as a battery, or a conventional electrical circuit. The wire 24 may also serve to suspend the base 12 from a support, such as a chandelier frame or in the case of Christmas lights a tree branch. The electrical wires are connected to the bipins 26 of the socket 22 by a suitable means such as soldering.

The ornamental lighting device 10 combines the light source 20 and the pendant prism 14 into a single unit.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. An ornamental lighting device comprising:

a base having an open end and a cavity communicating with said open end, a light source mounted within said cavity, and means for securing a pendant prism to said base at said open end, said prism having an opening extending therethrough adjacent one end of said prism, said securing means including at least one opening formed in said base adjacent said open end and means passing at least partially through said opening of said prism and said opening in said base.

2. The device of claim 1 wherein:

said light source comprises an electrical bulb, and means for supplying electrical energy to illuminate said bulb.

3. The device of claim 2 wherein:

said means for supplying electrical energy includes wires connecting said socket to a conventional electrical outlet.

4. The device of claim 3 further comprising:

means for suspending said base and said pendant prism from a desired support.

5. The device of claim 2 wherein:

said means for supplying electrical energy includes a power supply which is connected to a conventional electrical outlet.

6. The device of claim 2 wherein:

said means for supplying electrical energy includes a battery.

7. The device of claim 2 wherein:

said means for supplying electrical energy includes wires connecting said bulb to a conventional electrical outlet.

8. The device of claim 2 wherein:

said means for supplying electrical energy includes a power supply which is connected to a conventional electrical outlet.

9. The device of claim 1 wherein:

said light source comprises an electrical socket located in said cavity of said base, and an electrical bulb releasably attached to said electrical socket.

10. The device of claim 1 further comprising:

a reflective surface adjacent said open end of said base.

11. The device of claim 10 wherein:

said reflective surface serves to direct light from said light source into said pendant prism.

12. The device of claim 11 wherein:

said reflective surface is parabolically shaped to reflect light from said source into said pendant prism in a desired manner.

13. The device of claim 11 wherein:

said reflective surface is spherically shaped to reflect light from said source into said pendant prism in a desired manner.

14. The device of claim 1 further comprising:

a lens mounted within said cavity of said base to focus light from said source in a desired manner.

15. The lighting device of claim 1 wherein:

said means for securing a pendant prism to said base is releasable.

* * * * *